US008237071B2

(12) United States Patent
Yeh

(10) Patent No.: US 8,237,071 B2
(45) Date of Patent: Aug. 7, 2012

(54) ULTRA-THIN, ELECTRONICALLY CONDUCTIVE SLICE FOR BUTTON USE

(76) Inventor: Yi-Zen Yeh, Dongguan (CN)

( * ) Notice: Subject to any disclaimer, the term of this patent is extended or adjusted under 35 U.S.C. 154(b) by 241 days.

(21) Appl. No.: 12/802,181

(22) Filed: Jun. 1, 2010

(65) Prior Publication Data

US 2010/0300853 A1 Dec. 2, 2010

(30) Foreign Application Priority Data

May 28, 2009 (CN) ..... 2009 2 0057627

(51) Int. Cl.
*H01H 1/20* (2006.01)

(52) U.S. Cl. ..... 200/243; 200/262

(58) Field of Classification Search ..... 200/262, 200/243

See application file for complete search history.

(56) References Cited

U.S. PATENT DOCUMENTS

| | | | | |
|---|---|---|---|---|
| 1,958,357 | A * | 5/1934 | Weiger | 200/262 |
| 2,866,047 | A * | 12/1958 | Stuellein et al. | 200/262 |
| 4,671,688 | A * | 6/1987 | Brashears | 200/304 |
| 5,861,865 | A * | 1/1999 | Anand et al. | 345/658 |
| 6,072,130 | A * | 6/2000 | Burgess | 200/86 R |
| 7,109,429 | B1 * | 9/2006 | Lee | 200/283 |
| 7,642,469 | B2 * | 1/2010 | Arakawa et al. | 174/381 |
| 7,679,015 | B2 * | 3/2010 | Cheng | 200/310 |

* cited by examiner

*Primary Examiner* — Briggitte R Hammond
(74) *Attorney, Agent, or Firm* — Charles E. Baxley

(57) ABSTRACT

An ultra-thin, electrically conductive slice for button use, which includes a non-metallic matrix and a metal mesh. The metal mesh is provided in the non-metallic matrix. A plurality of metal touch points are provided on the metal mesh and exposed out of a surface of the non-metallic matrix so as to enable the surface of the non-metallic matrix to form a dense, electrically conductive mesh. The non-metallic matrix is rubber or silica. The metal mesh is electrically conductive.

4 Claims, 8 Drawing Sheets

ULTRA-THIN, ELECTRONICALLY CONDUCTIVE SLICE FOR BUTTON USE

1. CROSS REFERENCE TO RELATED APPLICATIONS

The instant patent application claims priority from Chinese patent application number CN 200920057627.5, filed on May 28, 2009, for an ULTRATHIN ELECTRICALLY CONDUCTIVE SLICE FOR BUTTON USE, and incorporated herein by reference thereto.

2. BACKGROUND OF THE INVENTION

1. A. Field of the Invention

The embodiments of the present invention relate to buttons, and more particularly, the embodiments of the present invention relate to an ultra-thin, electrically conductive slice for button use.

2. B. Description of the Prior Art

Normally, a prior art button has components including a keycap and electrically conductive rubber. The electrically conductive rubber is used to connect to a printed circuit board so as to enable normal operation of the button via the cooperation of the electrically conductive rubber and the printed circuit board.

The electrically conductive rubber known in the prior art is formed by mechanical pressing, using a mixture of metal powder and rubber. Due to the random state of the metal powder and the possible uneven mixing, however, the electrically conductive property and the anti-high current and anti-high voltage characteristics are poor such that actuation sensitivity of the button is affected.

3. SUMMARY OF THE INVENTION

Thus, an object of the embodiments of the present invention is to provide an ultra-thin, electrically conductive slice for button use, which avoids the disadvantages of the prior art.

Another object of the embodiments of the present invention is to provide an ultra-thin, electrically conductive slice for button use, which has improved electrically conductive property and anti-high current and anti-high voltage characteristics.

Briefly stated, yet another object of the embodiments of the present invention is to provide an ultra-thin, electrically conductive slice for button use, which includes a non-metallic matrix and a metal mesh. The metal mesh is provided in the non-metallic matrix. A plurality of metal touch points are provided on the metal mesh and exposed out of a surface of the non-metallic matrix so as to enable the surface of the non-metallic matrix to form a dense electrically conductive mesh. The non-metallic matrix is rubber or silica. The metal mesh is electrically conductive.

When compared with the prior art, the embodiments of the present invention—by replacing the prior art metal powder with the electrically conductive metal mesh—has the advantage of the electrical conductivity, the anti-high voltage and the anti-high current characteristics, and the sensitivity of the button being effectively improved. The embodiments of the present invention would bode well for use as cell phone buttons.

The novel features considered characteristic of the embodiments of the present invention are set forth in the appended claims. The embodiments of the present invention themselves, however, both as to their construction and their method of operation together with additional objects and advantages thereof will be best understood from the following description of the specific embodiments when read and understood in connection with the accompanying figures of the drawing.

4. BRIEF DESCRIPTION OF THE FIGURES OF THE DRAWING

The figures of the drawing are briefly described as follows.

5. LIST OF REFERENCE NUMERALS UTILIZED IN THE FIGURES OF THE DRAWING

Figure 1:
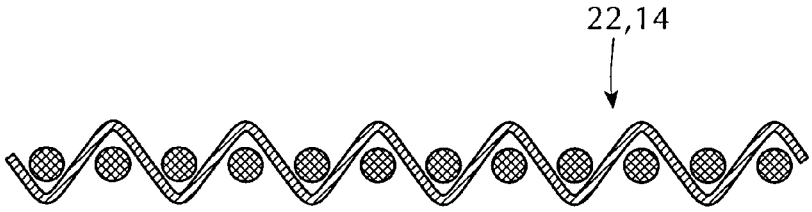
FIG. 1 is a diagrammatic cross sectional view of the electrically conductive metal mesh of the ultra-thin, electrically conductive slice of an embodiment of the present invention.

A. General.

10 ultra-thin, electrically conductive slice of embodiment of present invention for button use B. Overall Configuration of Ultra-Thin, Electrically Conductive Slice 10.

12 non-metallic matrix
14 metal mesh
16 plurality of metal touch points
18 surface of non-metallic matrix 12
20 dense, electrically conductive mesh C. Method of Making Ultra-Thin, Electrically Conductive Slice 10.

22 entire piece of electrically conductive metal mesh
23 gel mesh
24 single-piece gelled-mesh
26 vulcanized gelled mesh
28 metal touch points
30 pair of opposing surfaces of vulcanized gelled mesh 26
32 electrically conductive mesh piece
34 gel mesh piece
36 single-piece gelled mesh piece
38 vulcanized gelled mesh piece

6. DETAILED DESCRIPTION OF THE PREFERRED EMBODIMENTS

A. General

Figure 2:
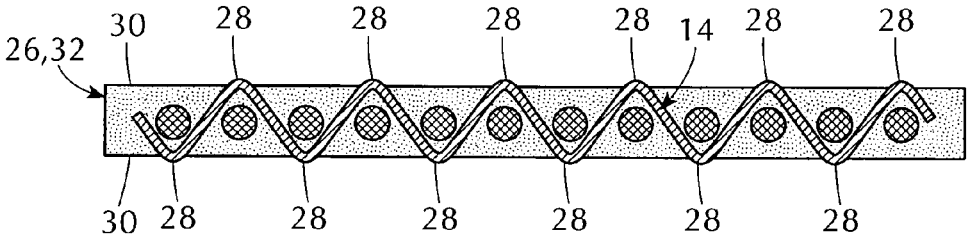
FIG. 2 is a diagrammatic cross sectional view of the electrically conductive metal mesh and a portion of the rubber or silica matrix of a partially completed ultra-thin, electrically conductive slice of an embodiment of the present invention.
Figure 3:
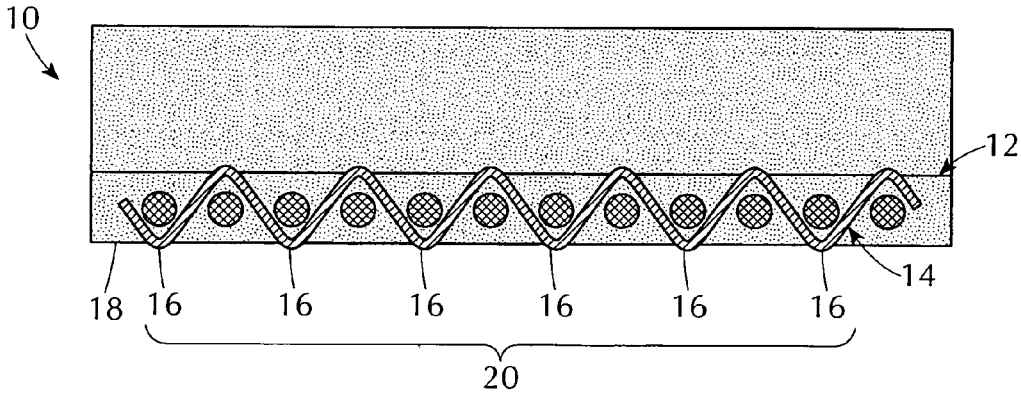
FIG. 3 is a diagrammatic cross sectional view of a completed ultra-thin, electrically conductive slice of an embodiment of the present invention.

Referring now to the figures, in which like numerals indicate like parts, and particularly to FIGS. 1-3, which are, respectively, a diagrammatic cross sectional view of the electrically conductive metal mesh of the ultra-thin, electrically conductive slice of an embodiment of the present invention, a diagrammatic cross sectional view of the electrically conductive metal mesh and a portion of the rubber or silica matrix of a partially completed ultra-thin, electrically conductive slice of an embodiment of the present invention, and a diagrammatic cross sectional view of the completed ultra-thin, electrically conductive slice of an embodiment of the present invention, the ultra-thin, electrically conductive slice of an embodiment of the present invention is shown generally at 10 for button use.

B. The Overall Configuration of the Ultra-Thin, Electrically Conductive Slice 10

The ultra-thin, electrically conductive slice 10 comprises a non-metallic matrix 12 and a metal mesh 14. The metal mesh 14 is provided in the non-metallic matrix 12. A plurality of metal touch points 16 are provided on the metal mesh 14 and exposed out of a surface 18 of the non-metallic matrix 12 so as to enable the surface 18 of the non-metallic matrix 12 to form a dense, electrically conductive mesh 20.

C. The Specific Configuration of the Non-Metallic Matrix 12 and the Metal Mesh 14

The non-metallic matrix 12 is rubber or silica. The metal mesh 14 is electrically conductive.

D. The Method of Making the Ultra-Thin, Electrically Conductive Slice 10

The method of making the ultra-thin, electrically conductive slice 10 can best be seen in FIGS. 1, 2, 3, and 4A-4G, which are a flow chart of the method of making the ultra-thin, electrically conductive slice, and as such, will be discussed with reference thereto.

Figure 4A:
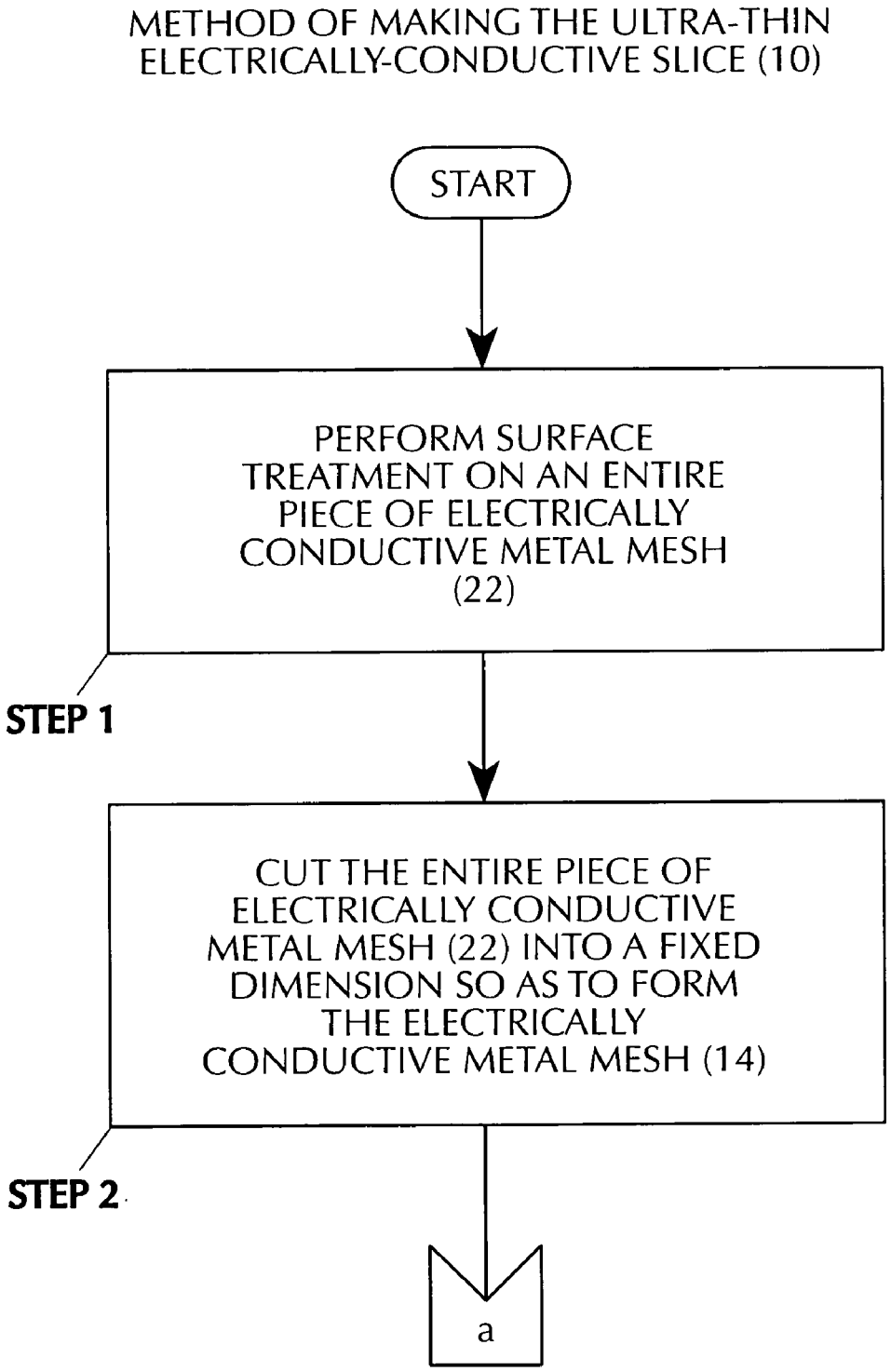
FIGS. 4A-4G are a flow chart of the method of making the ultra-thin, electrically conductive slice.

STEP 1: As shown in FIGS. 1 and 4A, perform a surface treatment on an entire piece of electrically conductive metal mesh 22.

STEP 2: As further shown in FIGS. 1 and 4A, cut the entire piece of electrically conductive metal mesh 22 into a fixed dimension so as to form the electrically conductive metal mesh 14.

Figure 4B:
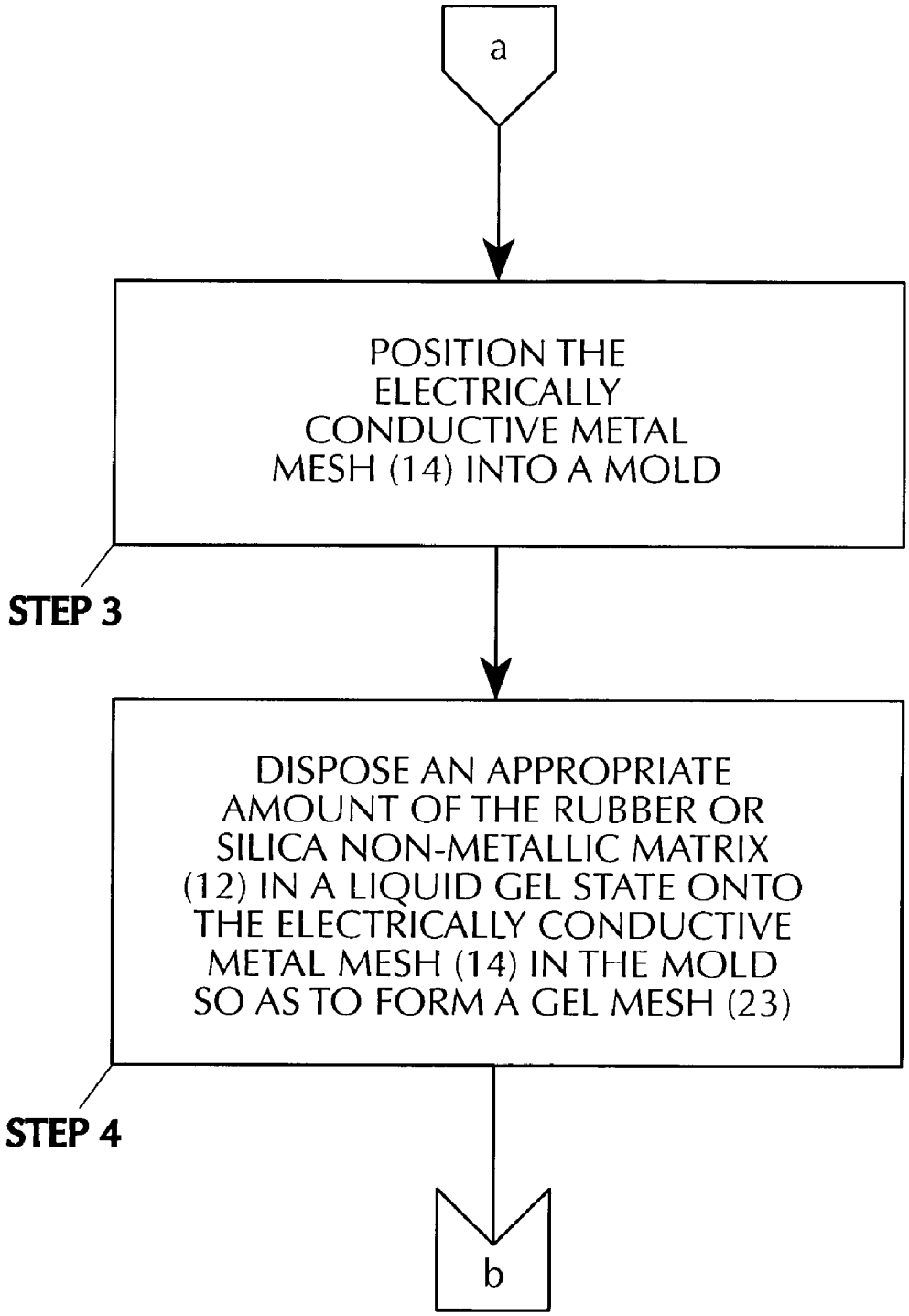

STEP 3: As shown in FIG. 4B, position the electrically conductive metal mesh 14 into a mold.

STEP 4: As further shown in FIG. 4B, dispose an appropriate amount of the rubber or silica non-metallic matrix 12 in a liquid gel state onto the electrically conductive metal mesh 14 in the mold so as to form a gel mesh 23.

Figure 4C:
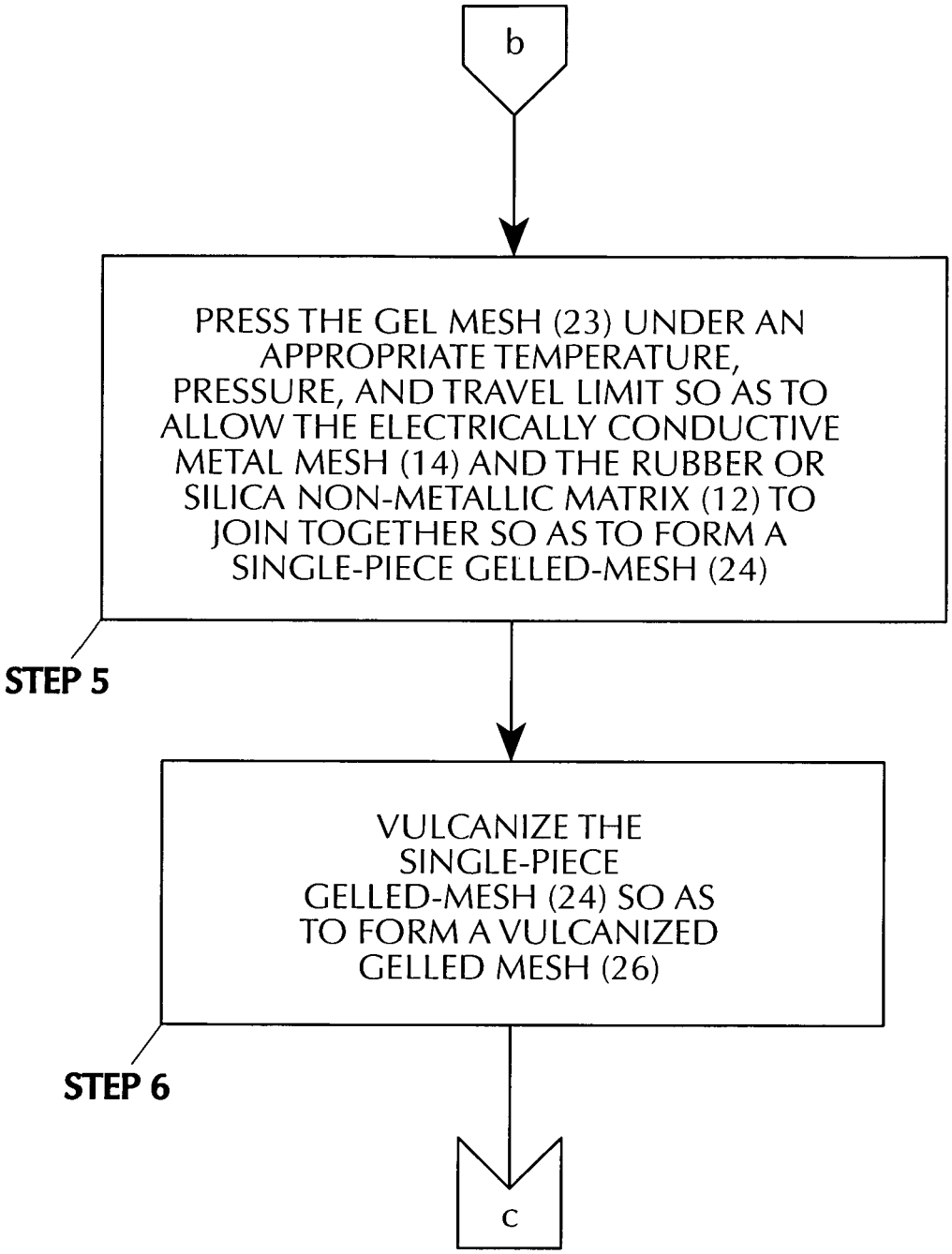

STEP 5: As shown in FIG. 4C, press the gel mesh 23 under an appropriate temperature, pressure, and travel limit so as to allow the electrically conductive metal mesh 14 and the rubber or silica non-metallic matrix 12 to join together so as to form a single-piece gelled-mesh 24.

STEP 6: As further shown in FIG. 4C, vulcanize the single-piece gelled-mesh 24 so as to form a vulcanized gelled mesh 26.

Figure 4D:
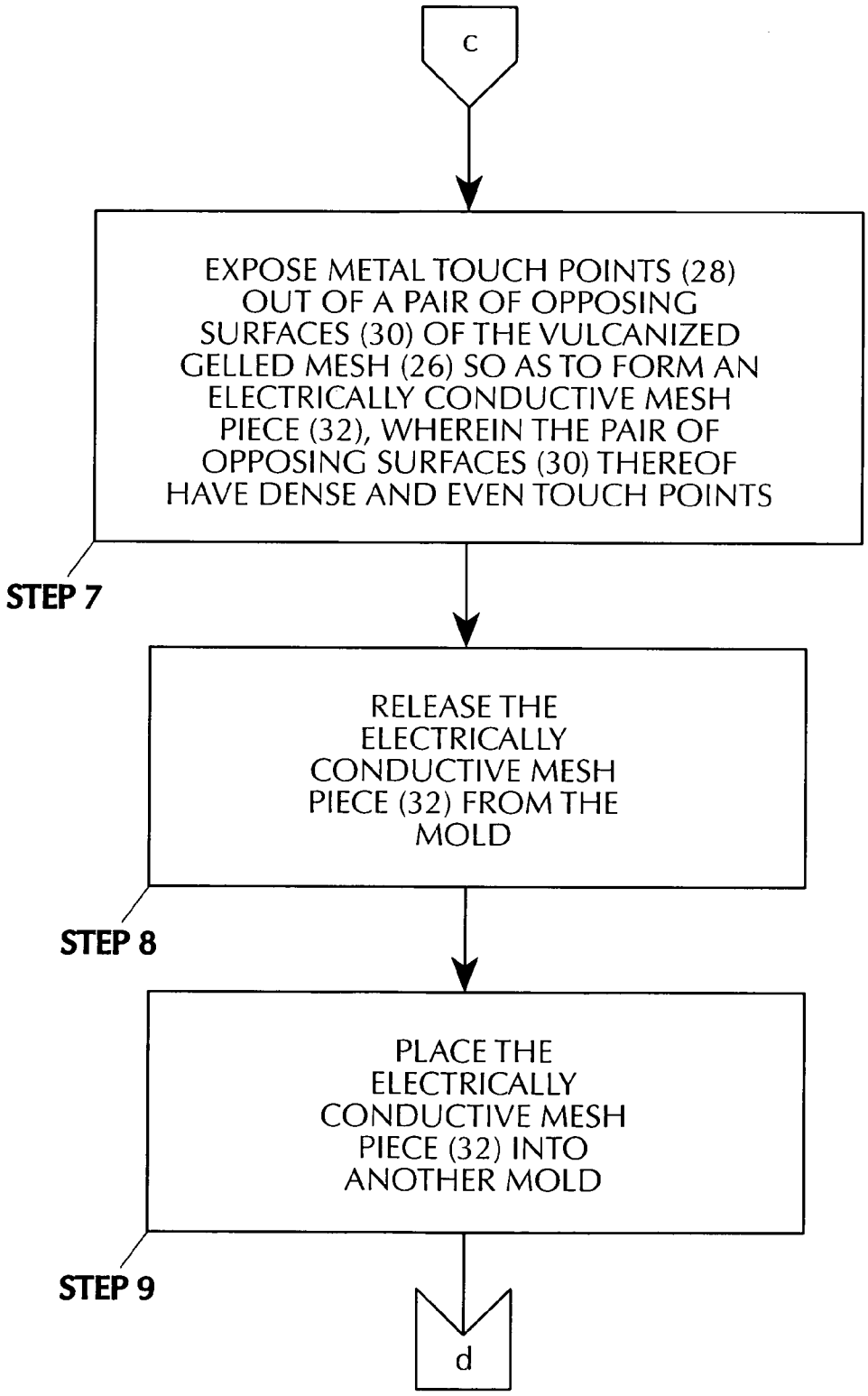

STEP 7: As shown in FIGS. 2 and 4D, expose metal touch points 28 out of a pair of opposing surfaces 30 of the vulcanized gelled mesh 26 so as to form an electrically conductive mesh piece 32, wherein the pair of opposing surfaces 30 have dense and even touch points.

STEP 8: As further shown in FIG. 4D, release the electrically conductive mesh piece 32 from the mold.

STEP 9: As further shown in FIG. 4D, place the electrically conductive mesh piece 32 into another mold.

Figure 4E:
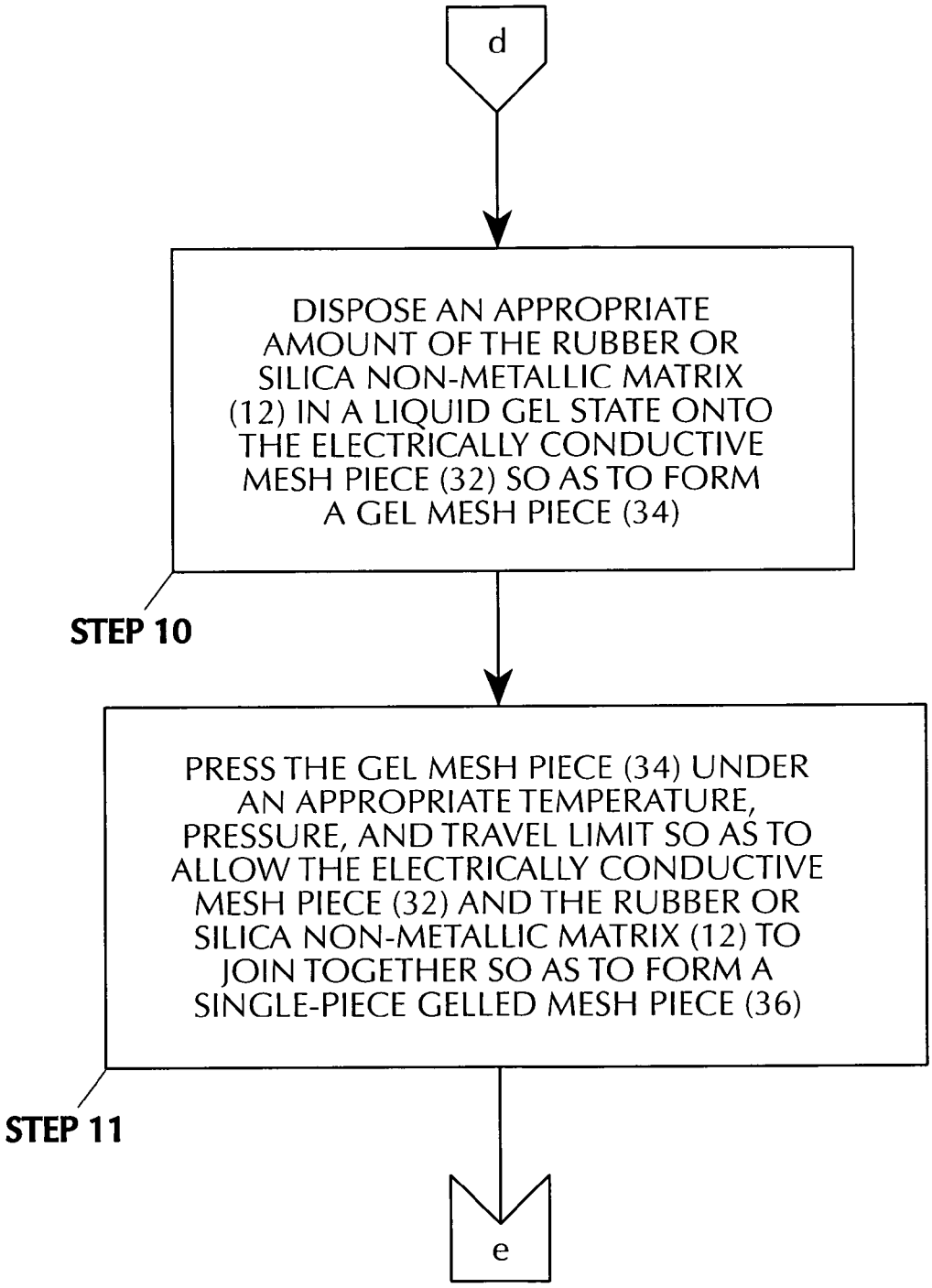

STEP 10: As shown in FIG. 4E, dispose an appropriate amount of the rubber or silica non-metallic matrix 12 in a liquid gel state onto the electrically conductive mesh piece 32 so as to form a gel mesh piece 34.

STEP 11: As further shown in FIG. 4E, press the gel mesh piece 34 under an appropriate temperature, pressure, and travel limit so as to allow the electrically conductive mesh piece 32 and the rubber or silica non-metallic matrix 12 to join together so as to form a single-piece gelled mesh piece 36.

Figure 4F:
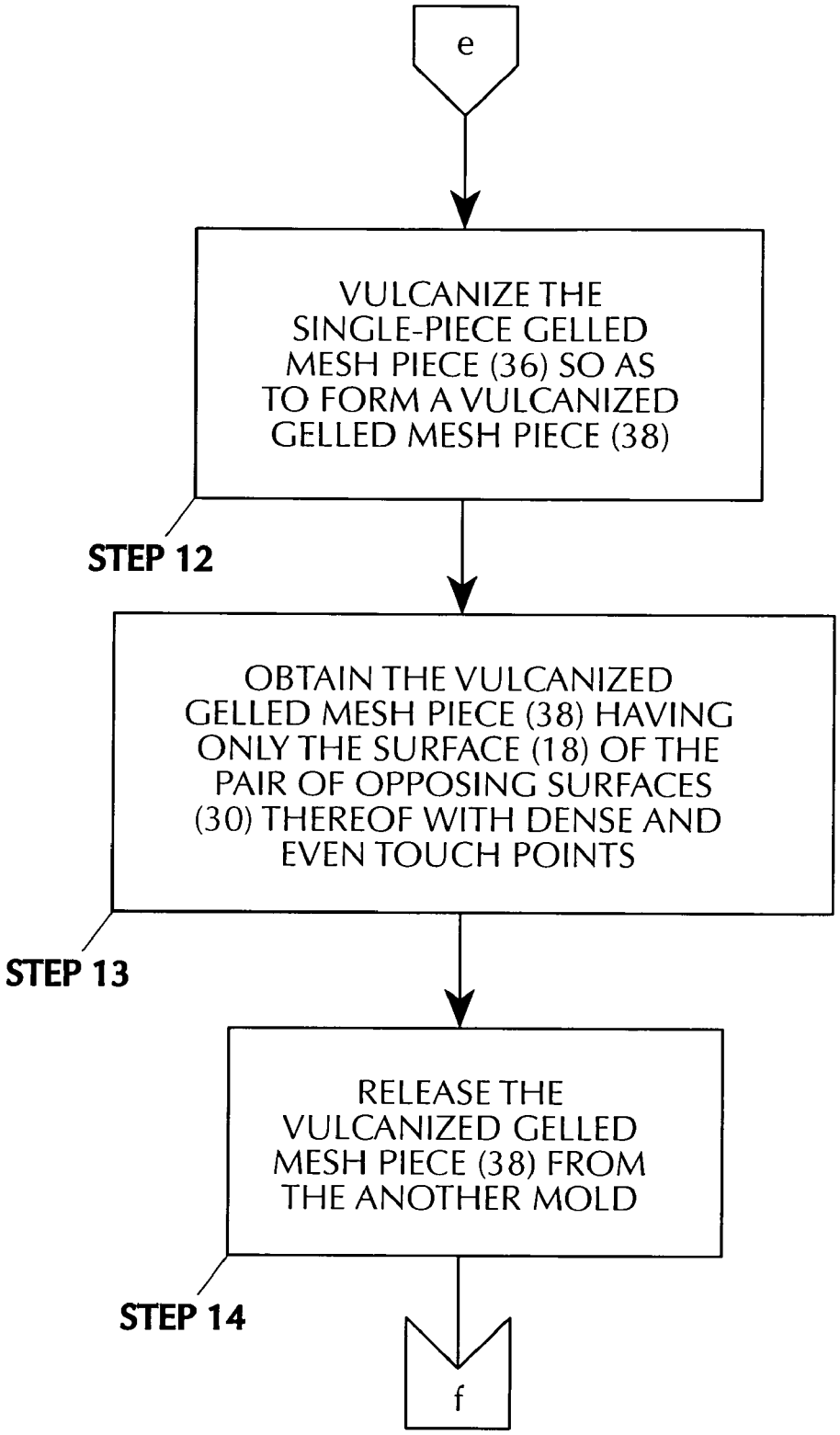

STEP 12: As shown in FIG. 4F, vulcanize the single-piece gelled mesh piece 36 so as to form a vulcanized gelled mesh piece 38.

STEP 13: As further shown in FIG. 4F, obtain the vulcanized gelled mesh piece 38 having only the surface 18 of the pair of opposing surfaces 30 thereof with dense and even touch points.

STEP 14: As further shown in FIG. 4F, release the vulcanized gelled mesh piece 38 from the another mold.

Figure 4G:
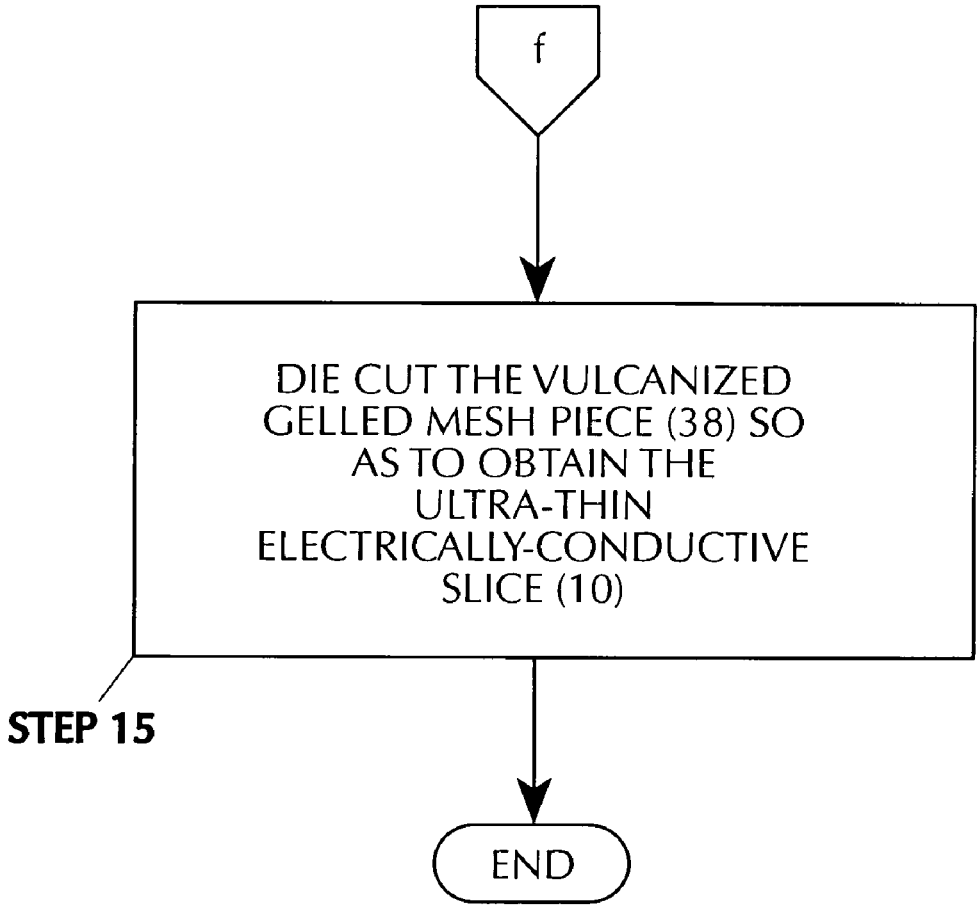

STEP 15: As shown in FIGS. 3 and 4G, die cut the vulcanized gelled mesh piece 38 so as to obtain the ultra-thin, electrically conductive slice 10.

E. Impressions

It will be understood that each of the elements described above or two or more together may also find a useful application in other types of constructions differing from the types described above.

While the embodiments of the present invention have been illustrated and described as embodied in an ultra-thin, electrically conductive slice for button use, however, they are not limited to the details shown, since it will be understood that various omissions, modifications, substitutions, and changes in the forms and details of the embodiments of the present invention illustrated and their operation can be made by those skilled in the art without departing in any way from the spirit of the embodiments of the present invention.

Without further analysis the foregoing will so fully reveal the gist of the embodiments of the present invention that others can by applying current knowledge readily adapt them for various applications without omitting features that from the standpoint of prior art fairly constitute characteristics of the generic or specific aspects of the embodiments of the present invention.

The invention claimed is:

1. An ultra-thin, electrically conductive slice for button use, comprising:

a) a non-metallic matrix; and b) a metal mesh;

wherein said metal mesh is provided in said non-metallic matrix; and wherein a plurality of metal touch points are provided on said metal mesh and exposed out of a surface of said non-metallic matrix so as to enable said surface of said non-metallic matrix to form a dense, electrically conductive mesh.

2. The slice of claim 1, wherein said non-metallic matrix is rubber.

3. The slice of claim 1, wherein said non-metallic matrix is silica.

4. The slice of claim 1, wherein said metal mesh is electrically conductive.

* * * * *